US007322301B2

(12) United States Patent
Childs

(10) Patent No.: US 7,322,301 B2
(45) Date of Patent: Jan. 29, 2008

(54) SYSTEM AND METHOD FOR PROCESSING SEWAGE SLUDGE AND OTHER WET ORGANIC BASED FEEDSTOCKS TO GENERATE USEFUL END PRODUCTS

(76) Inventor: Wayne Childs, 453 S. Main St., Unit C, Attleboro, MA (US) 02703

( * ) Notice: Subject to any disclaimer, the term of this patent is extended or adjusted under 35 U.S.C. 154(b) by 262 days.

(21) Appl. No.: 11/057,998

(22) Filed: Feb. 15, 2005

(65) Prior Publication Data

US 2005/0145578 A1 Jul. 7, 2005

Related U.S. Application Data

(63) Continuation of application No. 10/230,613, filed on Aug. 29, 2002, now abandoned.

(51) Int. Cl.
*F23B 7/00* (2006.01)

(52) U.S. Cl. ..... 110/341; 110/229; 110/224

(58) Field of Classification Search ..... 110/245, 110/246, 224, 226, 229; 34/379
See application file for complete search history.

(56) References Cited

U.S. PATENT DOCUMENTS 3,954,069 A * 5/1976 Loken ..... 110/221
4,311,103 A * 1/1982 Hirose ..... 110/238
4,997,711 A * 3/1991 Takahashi et al. ..... 428/357
5,079,091 A * 1/1992 Takahashi et al. ..... 428/357
5,411,714 A * 5/1995 Wu et al. ..... 422/232
5,634,281 A * 6/1997 Nugent ..... 34/207
6,190,429 B1 * 2/2001 Fujimura et al. ..... 48/197 R

* cited by examiner

*Primary Examiner*—Kenneth Rinehart
(74) *Attorney, Agent, or Firm*—Joseph E. Funk

(57) ABSTRACT

A system and method are disclosed for processing sewerage sludge and other organic based feedstocks, in an energy efficient manner that minimizes or eliminates unwanted byproducts, including pathogens, and generates useful environmentally safe products. The sewage sludge or other feedstocks are partially dried before being input to a gasifier operating under partial pyrolytic conditions with a small amount of oxygen or air present to produce fuel in the form of synthesis gas, bio-oil fuel, and char. A small percentage of the fuel may be used to maintain the operation of the feedstock drying process after it is started and a small amount of the synthesis gas produced in the gasifier reacts with the small amount of oxygen present with the feedstock to maintain the pyrolysis temperature in the gasifier in order to make the system economically viable.

7 Claims, 2 Drawing Sheets

(Informal)

(Informal)

(Informal)

SYSTEM AND METHOD FOR PROCESSING SEWAGE SLUDGE AND OTHER WET ORGANIC BASED FEEDSTOCKS TO GENERATE USEFUL END PRODUCTS

This is a continuation of utility patent application Ser. No. 10/230,613, filed Aug. 29, 2002 now abandoned.

FIELD OF THE INVENTION

This invention relates to processing of sewerage sludge and other organic based feedstocks in a way that generates more energy than is used to process the sewage sludge into useful products, destroy pathogens and minimize or eliminate byproducts.

BACKGROUND OF THE INVENTION

Various methods have been developed over the years to dispose of sewage sludge. Such methods include wet spreading, composting, land filling, incineration, and special processing that requires dewatering, drying and heat treatment to produce a fertilizer which is substantially free of pathogens (a product designated by the EPA as "Class A Biosolids"). However, these methods are proving to be controversial and unacceptable in today's environment. As more and more landfills close transportation costs to new locations have increased. Wet application is not sufficiently sanitary, and often results in the contamination of local streams, rivers and groundwater supplies. Although biosolids fertilizer is rich in nutrients, its heavy metal content has raised questions about the acceptability of its repeated application to farmland, which may cause a cumulative buildup of metals like cadmium, lead, mercury, selenium, silver and other toxic metals.

Sewage sludge has a high water content, and requires dewatering prior to wet spreading, composting, land filling, incineration or thermal treatment to manufacture biosolids. Typically, dewatering is carried out with settling tanks, screening systems filter presses, belt filter presses or centrifuges. Drying uses cylindrical rotary kilns, kilns with overlying beds, grinding driers or indirect driers of different construction. A representative apparatus for drying sewerage sludge is disclosed in U.S. Pat. No. 5,634,281. A representative apparatus for incineration of sewage sludge is disclosed in U.S. Pat. No. 3,954,069. Another such apparatus is disclosed in U.S. Pat. No. 4,311,103.

The steps of dewatering and drying sewerage sludge to manufacture biosolids fertilizer requires significant amounts of energy, which is obtained using hydrocarbon-based fuels that are subject to price instability and a growing scarcity. Electrical energy may also be used but is extremely impractical due to its cost.

Ashes from the incineration of sewerage sludge may be disposed of directly into landfills, may receive further processing before disposal, or may be converted into value-added products. U.S. Pat. Nos. 5,079,091 & 4,997,711 teach compaction of sewerage sludge incineration ashes to have the bulk specific gravity of 0.9-2.5 that enables mass dumping without causing secondary pollution. Further, if the compacted ashes are then fired to have the bulk specific gravity of 1.4-3.5, both the volume and weight are reduced much more, realizing easy handling of the resultant burned product. However, due to the high cost of drying and incineration or other processes needed to convert sewerage sludge ash into value-added products, which have yet to be proven cost effective, there is no real recovery of the costs associated with these disposal options.

Thus, there is a need in the art to reduce the cost of processing and disposing of sewerage sludge. This includes the use or disposal of any final by product(s).

SUMMARY OF THE INVENTION

The present invention solves the problem in the prior art by teaching the disposal of sewerage sludge or other organic based feedstocks in a cost-effective manner. More particularly, the present invention makes use of latent energy in the feedstocks, including sewage sludge, to drive the system, to safely dispose of same, and produce useful, safe products (pathogen free), including electrical energy and synthetic fuels, while minimizing or eliminating the production of harmful byproducts.

The invention is a system and method for processing sewerage sludge and other organic based feedstocks in an energy efficient manner that allows the manufacture of useful products, wherein the sewage sludge or other organic based feedstocks are dewatered and dried before being input to a fluidized bed gasifier system operating under pyrolytic conditions with a controlled small amount of oxygen present in the feedstock to produce fuel in the form of synthesis gas and pyrolytic oil (also called bio-oil and referred to as such in this specification), and char (ash and carbon powders). Some of the fuel produced reacts with the small amount of oxygen present to maintain the temperature of the fluidized bed gasifier system to pyrolize the feedstock after the system has started, and some of the fuel may be burned to heat and dewater the feedstock, thereby making the system economically viable, and the remaining synthesis gas, pyrolytic oil and char are used to produce useful, environmentally safe, end products.

First, sewerage sludge or other organic based feedstocks are dewatered to have between 25% and 30% solids (70%-75% water) content using mechanical means such as centrifugal separation. It is then dried using thermal energy to between 75% and 95% dryness, followed by processing in a gasifier to produce energy-containing products such as synthesis gasses, bio-oil and char. An auxiliary energy source, usually natural gas, is initially input to the system to produce the thermal energy required for drying the sewerage sludge to an acceptable degree before a pyrolytic or gasification process can be employed to manufacture synthesis gas, bio-oil and char from the sewage sludge. When the system is properly functioning a percentage of the synthesis gas, bio-oil and char manufactured may be used to replace the auxiliary energy supply, thus eliminating one of the single greatest costs incurred in drying and heat treating sewage sludge.

Other than synthesis gas and bio-oil, the other byproduct of the drying and gasification process is char. The char is generally considered to be environmentally safe and may be buried, however as is the case with biosolids it may contain trace amounts of heavy metals. This char may be processed further to produce safe, useful end products as described in the following paragraph.

To accomplish the production of safe, useful end products from the char some of the remaining synthesis gas and/or bio-oil may be burned to produce the thermal energy necessary to further process the char. One such process involves mixing the char with cement, pelletizing the mixture to produce an aggregate and exposing the aggregate to elevated temperatures in a sintering furnace. The finished product can be safely added to concrete in place of natural aggregate.

Another safe and useful end product is produced by adding some sand to the char and vitrifying the combination in either a direct resistance heated or Joule heated furnace or by some other means such as exposing the ash to a high temperature plasma The vitrified material is environmentally safe and may be buried, or used as fill in construction projects, or it may be mechanically processed further to produce an abrasive frit that is in high demand for sand blasting applications.

DESCRIPTION OF THE DRAWING

The invention will be better understood upon reading the following Detailed Description in conjunction with the drawing in which.

DETAILED DESCRIPTION

Figure 1:
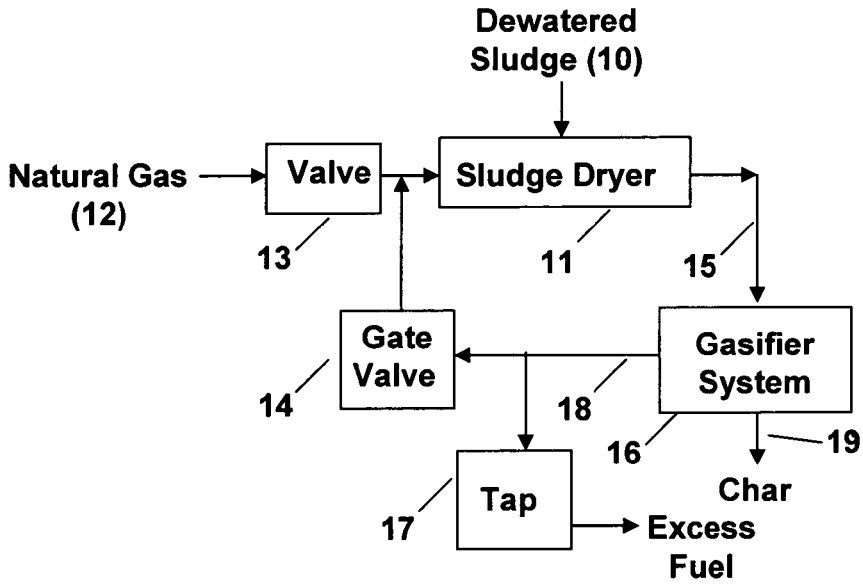
FIG. 1 is a block diagram of a system that uses a supplemental fuel to start the system for processing dewatered sewage sludge to produce synthetic gas, bio-oil and char, some of which may be returned to the dryer or gasifier or burned in the sewage sludge drying system to continue its operation.

In FIG. 1 is shown a block diagram of a system that initially uses a fuel, such as natural gas but other fuel gasses may be used, to start the partial drying of sewerage sludge and other organic based feedstock materials, to produce safe, useful end products such as fuels synthetic gasses or bio-oil, and char that may be recycled into useful byproducts. Thus, the operation is energy efficient, environmentally safe and economically viable. Hereinafter, such organic based feedstock waste are only referred to as sewerage sludge, but those skilled in the art will understand that any organic based feedstock materials may be processed using the novel method disclosed herein.

Pyrolytic and/or gasification processes are capable of extracting synthesis gasses such as carbon monoxide (CO) and hydrogen ($H_2$) from a wide range of organic materials including, sewage sludge. In the following description sewage sludge is referenced but other materials, (i.e. feed stocks), may also be processed using the teaching of the novel process.

The present invention combines the operation of wet sewage sludge drying equipment 11 driven by fuels 12, gaseous fuels in FIG. 1, to dry the wet sewage sludge 10 to between 75% and 95% dryness, and a fluidized bed gasifier system 16 where the wet sewage sludge 10 is heated under conditions to break down the feedstock and produce synthesis gasses carbon monoxide (CO) and hydrogen ($H_2$), bio-oil and char.

Before the wet sewage sludge is input to drying equipment 11 it is first dewatered somewhat using techniques known in the art, such as centrifugal separation, to have between 25% and 30% solids (70%-75% water) content. Such dewatering equipment is not shown in FIG. 1 or the other Figures. As the dewatering technology advances the amount of water that may be removed increases.

Some of the synthesis gasses may be used to drive other equipment, such as but not limited, to a steam boiler and generator, in order to produce electricity that may be used or sold.

More particularly, dewatered sludge 10 is first injected into a dryer 11 where it is heated and dried to between 75% and 95% dryness. To heat dewatered sewage sludge 10, natural gas 12 is initially provided through open valve 13 to dryer 11 where it is burned to heat dry the sewage sludge 10 to the level described in the previous sentence. Other gaseous fuels may also be used although natural gas is preferred for economic reasons. Initially, valve 14 is closed but is later opened as is described further in this description. Sludge dryers are well known in the art so are not described in detail here.

As sludge 10 is partially dried to a desired level between 75% and 95% dryness it is transferred via line 15 to gasifier system 16 in a continuous manner. In gasifier system 16, operating under pyrolytic conditions with a small amount of oxygen present, the dried sludge is heated to the range of 970° Fahrenheit and 2,600° Fahrenheit, to drive off the synthesis gasses carbon monoxide (CO) and hydrogen ($H_2$) as the dried sludge degrades. Gasifier system 16 is a fluidized bed gasifier that has a bed of sand that is initially heated to a high temperature using a natural gas-fired heater and a blower (not shown but well known in the art). As the partially dried sludge contacts the heated sand in gasifier 16 synthesis gas, bio-oil products and char are produced. At the high temperature of the heated sand a small portion of the synthesis gasses generated are combusted with the small amount of oxygen permitted in gasifier 16 to generate heat that maintains the operating temperature of the gasifier. The amount of oxygen permitted into gasifier system 16 under the pyrolytic conditions is adjusted to control the temperature of the gasifier system.

There are other types of gasifiers known in the art that may be adapted for use such as updraft, downdraft, cross draft, fixed bed, and moving bed gasifiers, some of which are for gasification of coal, but the fluidized bad gasifier is preferred in the preferred embodiment of the invention described herein.

As the synthesis gasses are generated and output from gasifier system 16 on output line 18, valve 14 is opened and valve 13 is closed to direct a portion of the synthesis gasses to the dryer 11 in which it is burned to continuously drive the system. With natural gas only being used to start the operation of the system shown in FIG. 1, and the synthesis gasses being used thereafter, the operation actually produces energy and is energy efficient. Excess synthesis gas tapped off at valve 17 is used to drive other equipment such as, but not limited, to a steam boiler and generator, to produce electricity that may be used or sold.

As sludge 10 degrades in gasifier 16 it turns into char, which is composed of charcoal and ash that is output from gasifier 16 via line 19. Char is fairly environmentally benign and may be safely disposed of, or it can be re-injected into gasifier 16, or it can be used to produce other valuable byproducts besides the synthesis gasses and/or the bio-oil. One such char end product is an aggregate made by mixing the char with cement and pelletizing the mixture to produce an artificial aggregate that can be safely added to concrete instead of natural stone. Another safe and useful end product is produced (if a high temperature gasifier is not being used that will ordinarily melt the char) by melting or vitrifying the char in either a direct resistance heating or Joule heated furnace, or by some other means such as exposing the char to a high temperature plasma. The vitrified material is environmentally neutral and may be buried, used as fill in construction projects, or it may be mechanically processed further to produce an abrasive frit that is in high demand for sand blasting applications. The char may also be further processed using techniques such as those described in U.S. Pat. Nos. 5,047,145, 5,227,047 and 6,027,551 that allow the carbon to be separated from the ash and upgraded in purity. It is then possible to convert the carbon into activated carbon and utilize the remaining ash as a very high-grade pozolin admix for the production of lightweight concrete.

While FIG. 1 shows the use of natural gas to start the system, with the synthesis gasses used thereafter, it will be appreciated by those skilled in the art that other fuels may be input via valve 13 to start the operation of the system. These other fuels include, but are not limited to, fuel oil.

Figure 2:
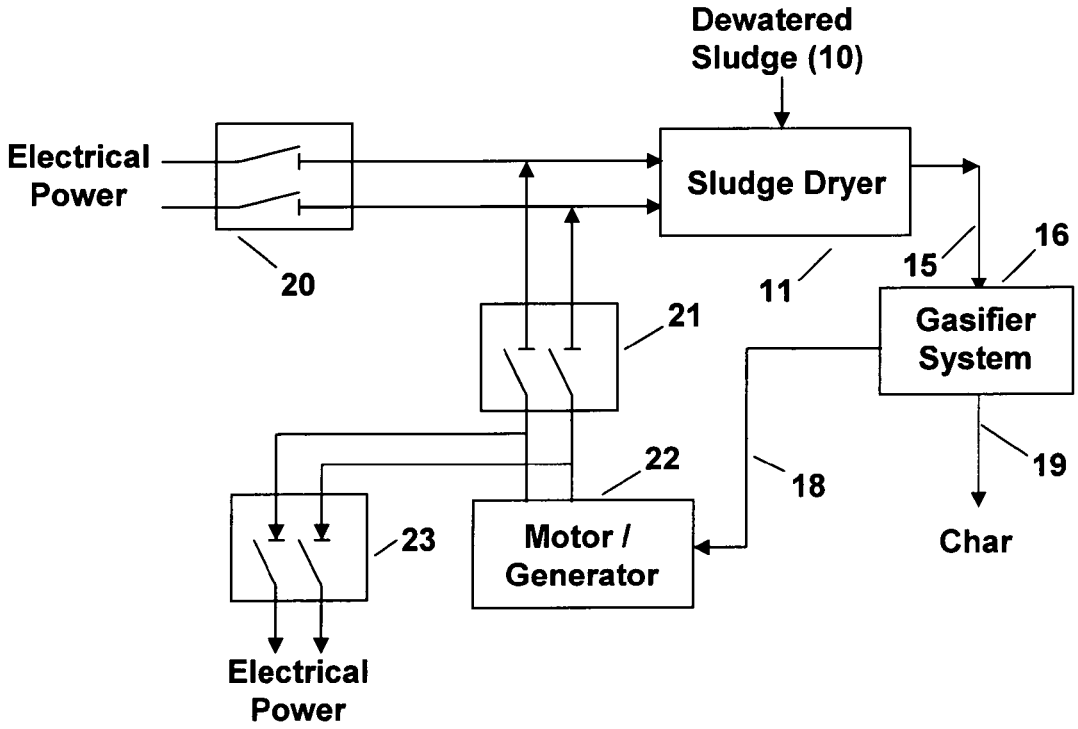
FIG. 2 is a block diagram of a system that uses electricity to start the system processing sewage sludge to produce synthetic gas, bio-oil and char, some of which may be returned to the dryer or gasifier or burned in the sewage sludge drying system to continue its operation.

In FIG. 2 is shown a block diagram of a system that uses electricity to start the system processing sewerage sludge to produce synthetic gasses and pyrolytic oil (also called bio-oil and referred to as such in this specification), some of which may be re-injected into gasifier 16 together with char, or be sold. The operation of dryer 11 and gasifier system 16 and their end products are the same as described with reference to FIG. 1 and are not repeated here for the sake of brevity.

The difference in FIG. 2 is how dryer 11 is heated. As may be seen in FIG. 2 a source of electrical power is connected via switch 20 to dryer 11, Gasifier 16 is pre-heated using natural gas as previously described with reference to FIG. 1. The synthesis gasses or bio-oil output from gasifier 16 on line 18 are input to a motor—generator set 22 where the gasses are used to drive the motor and the electricity produced by the generator is output to switches 21 and 23. Once enough electricity is being produced by motor—generator set 22, power line switch 20 is opened and switch 21 is closed so that the heater of dryer 11 is then energized solely by electricity generated using the synthesis gasses or bio-oil output from gasifier 16. Switch 23 is closed to route excess generated electricity to be used elsewhere or sold. Alternatively, the synthesis gasses may be converted to electricity using fuel cells, a boiler and steam turbine or a gas turbine all of which are known in the art.

Figure 3:
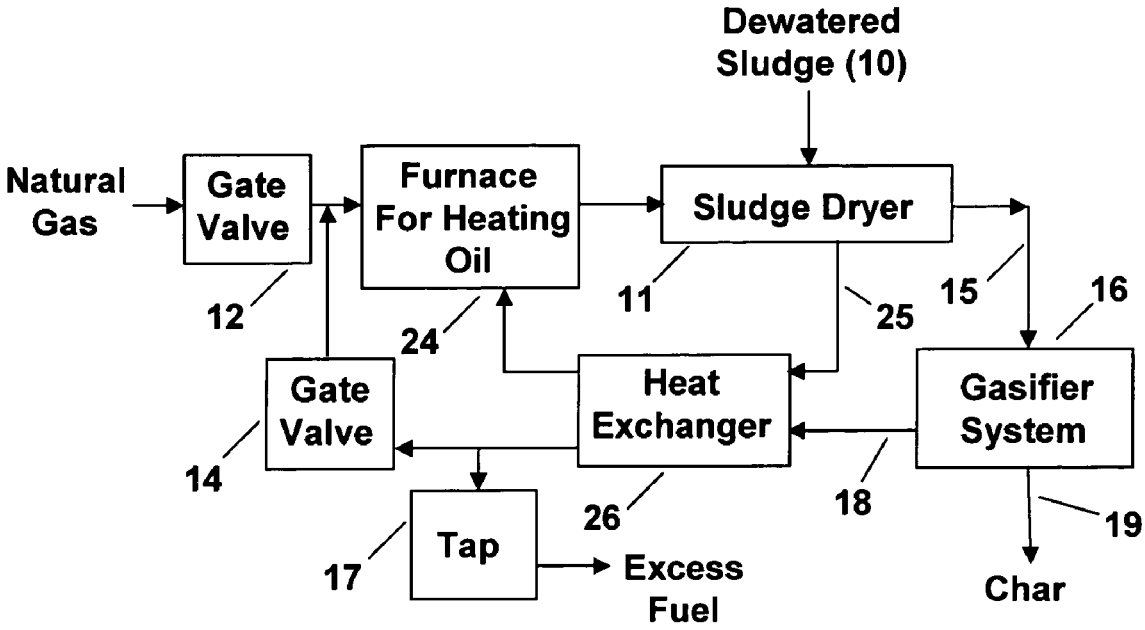
FIG. 3 is a block diagram of a system that uses a fuel to initially heat oil that is then used to start the system processing sewerage sludge to produce hot synthetic gas that is cooled to produce synthetic gas, bio-oil and char.

In FIG. 3 is a block diagram of a system that uses a fuel to initially heat-oil that is then used to start the process of drying wet sewage sludge. The basic operation of dryer 11 and gasifier system 16 and their end products are the same as described with reference to FIG. 1 and are not repeated here for the sake of brevity. Dryer 11 has a screw auger (not shown) for moving the dewatered sludge through dryer 11. The screw auger is hollow and heated oil is pumped therethrough to aid in the drying process. As the oil cools it exits dryer 11 to be reheated and cycled back to dryer 11.

In FIG. 3 a source of natural gas is initially applied via valve 12 to be used to fire furnace 24 and heat oil for use by the screw auger in dryer 11. The heated oil is output from furnace 24 and is input to dryer 11 where it is input to the hollow screw auger. As sludge passes over the screw auger it is heated and water is driven off, cooling the oil. The cooled oil exits dryer 11 via output 25 and is input to heat exchanger where it is partially heated by the hot synthesis gasses and bio-oil output from gasifier system 16 via path 18. The partially heated oil is then returned to furnace 24 where it further heated.

As the system reaches its static operational condition the still hot synthesis gasses and/or bio-oil pass through heat exchanger 26 to valve 14. Natural gas input valve 12 is closed and valve 14 is opened so that furnace 24 is heating the oil solely using the synthesis gasses and/or bio-oil. In addition, excess synthesis gasses and/or bio-oil are tapped off via valve 17 to be used to drive other equipment such as, but not limited, to a steam boiler and generator, to produce electricity that may be used or sold.

As previously described with reference to FIGS. 1 and 2, the char produced by gasifier system 16 may be safely disposed of, or be used to produce other valuable end products besides the synthesis gasses and bio-oil. These byproducts are described above with reference to FIG. 1, so are not described again for the sake of brevity.

While what has been described herein is the preferred embodiment of the invention it will be understood by those skilled in the art that numerous changes may be made without departing from the spirit and scope of the invention. For example, while a gasifier is used with the preferred embodiment of the invention, it may be replaced by a furnace operating fully pyrolytically with no oxygen, but a separate heating source must be provided to maintain the temperature inside the furnace. In addition, any excess heat generated by the system may be captured using heat exchangers to produce steam that can be used to drive a steam turbine that operates a generator.

The invention claimed is:

1. A method for processing wet sewage sludge or other feedstock including carbonaceous material principally composed of wet organic materials in a gasifier to produce useful products by pyrolizing the feedstock, the method comprising the steps of:

dewatering the sludge or feedstock using thermal energy in a location separate from the gasifier;

processing the feedstock under pyrolytic conditions with a small amount of oxygen or air present at a temperature required to break down the feedstock and produce fuel and char in the gasifier; and wherein some of the fuel produced during the feedstock processing step is fed back to the separate location and burned to provide the thermal energy required in the feedstock dewatering step and thereby minimize or eliminate the need for external energy to dry the wet feedstock.

2. The method in accordance with claim 1 wherein the fuel produced from the feedstock processing step includes carbon monoxide, hydrogen and bio-oil, and some amount of these fuels are output as useful end products.

3. The method in accordance with claim 2 further comprising the step of processing the char into useful end products.

4. A method for processing wet sewage sludge or other carbonaceous feedstock having excess amounts of moisture to produce useful products such as synthetic fuel gas by gasifying feedstock in a gasifier under pyrolytic conditions with a small amount of oxygen present, the method comprising the steps of:

mechanically dewatering feedstock that has a moisture content in excess of 75% to have a moisture content between 70% and 75%;

thermally dewatering the mechanically dewatered feedstock in a location separate from the gasifier to have a moisture content between 5% and 25%;

gasifying the thermally dewatered feedstock under pyrolytic conditions with a small amount of oxygen present at a temperature required to break down the feedstock and produce fuel and char; and wherein some of the fuel produced during the gasifying step is fed back to the separate location where it is burned to provide the thermal energy required for the thermal dewatering step, and thereby minimize or eliminate the need for external energy sources to thermally dry the feedstock before it is gasified.

5. The method for processing wet sewage sludge or other carbonaceous feedstock in accordance with claim 4 wherein the mechanically dewatering feedstock comprises techniques known in the art including screening systems, belt presses and centrifugal separation; and wherein an external energy source is initially used to thermally dewater the feedstock until fuel is produced in the gasifying step, a portion of which fuel can be burned to thermally dewater the feedstock.

6. The method for processing wet sewage sludge or other carbonaceous feedstock in accordance with claim 5 wherein a portion of the fuel produced in the feedstock gasifying step is used to drive an electrical generator and produce electricity for use in dewatering and drying the feedstock as well as to reduce or eliminate the need for externally supplied electrical energy to operate the gasification system.

7. The method for processing wet sewage sludge or other carbonaceous feedstock in accordance with claim 5 wherein the fuel produced from the gasifying step includes carbon monoxide, hydrogen and bio-oil, and some amount of these fuels are output as useful end products.

* * * * *